United States Patent [19]

Takehara

[11] Patent Number: 4,738,351

[45] Date of Patent: Apr. 19, 1988

[54] CONVEYOR FOR CONVEYING AN ADHESIVE BELT-LIKE OBJECT

[75] Inventor: Katsuomi Takehara, Mukou City, Japan

[73] Assignee: Kabushiki Kaisha Takehara Kikai Kenkyusho, Nagaokakyo, Japan

[21] Appl. No.: 824,964

[22] Filed: Jan. 31, 1986

[30] Foreign Application Priority Data

Feb. 22, 1985 [JP] Japan ..... 60-35089

[51] Int. Cl.[4] ..... B65G 15/14

[52] U.S. Cl. ..... 198/626; 271/272; 271/275

[58] Field of Search ..... 198/620, 624, 626–628; 226/170–172; 271/272–275

[56] References Cited

U.S. PATENT DOCUMENTS 2,553,456 5/1951 Howell ..... 198/626 X 2,790,540 4/1957 Gaubert ..... 198/626 X 2,986,912 6/1961 Richeson et al. ..... 198/626 X

FOREIGN PATENT DOCUMENTS 152755 9/1983 Japan ..... 271/272

58-183509 10/1983 Japan .

*Primary Examiner*—Robert J. Spar

*Assistant Examiner*—Lyle K. Kimms

*Attorney, Agent, or Firm*—Wenderoth, Lind & Ponack

[57] ABSTRACT

A conveyor having a conveying surface, which contacts an object to be conveyed, by plural coiled springs which rotate endlessly in accordance with the rotation of a main roller. The springs are trained over the main roller and a subordinate roller, which is provided at an appropriate distance from main roller and which rotates freely, in such a manner as the axis of spiral of each coiled spring runs in the direction of conveyance.

3 Claims, 4 Drawing Sheets

CONVEYOR FOR CONVEYING AN ADHESIVE BELT-LIKE OBJECT

BACKGROUND OF THE INVENTION

1. Field of the Invention

The present invention is related to a conveyor for conveying an industrial material, the surface of which is always sticky, for example, an object forming the adhesive surface of an adhesive belt-like object.

2. Description of the Prior Art

Up to now, this type of adhesive belt-like object was conveyed by means of either passing it on a long table with a teflon-coated surface or, after being cut into pieces to a desired length on the table, by piling them while inserting tearing-off papers therebetween. There has been no such conveyor with a conveying surface formed by belts or rollers. Among the conveyors designed for reducing an area of contact with an object to be conveyed with an object to be conveyed as much as possible, there are some which have conveying belts made of metal wires or nets or which have rotating ropes.

SUMMARY OF THE INVENTION

The conventional conveyors for conveying an adhesive belt-like object have disadvantages in that they lack continuity, they cannot be mechanized easily such as when it is required to cut the belt-like object automatically to a desired length, it is difficult to cut the object to a desired length in transit in the case of a conveyor which has conveyor belts made of nets or wires or ropes, and the adhesive object is liable to stick to the surface of those conveyors in transit.

Thus, it has been desired to develop a conveyor for conveying an adhesive belt-like object, which assures that the adhesive object does not stick to the continuously rotating conveyor and that the adhesive object is conveyed continuously to the desired position for cutting or the position for packing.

The invention offers a conveyor for conveying an adhesive belt-like object, which is characterized by a conveying surface which contacts an object to be conveyed formed by a plural number of endless coiled springs which rotate in accordance with the rotation of a main roller, and that such conveying surface is strained over the main roller and a subordinate roller, which is provided at an appropriate distance from the main roller and which rotates freely, in such a manner that the axis of the helix of each of the coiled springs runs in the direction of conveyance.

At the time when the endless coiled springs rotate in accordance with the rotation of the main roller, the pitches or distances between outer portions of the turns of the coiled springs, which are close together along a linear portion of the conveyance path, spread out and travel in an arc shaped path along a non-linear portion of the conveyance path in the places where the inner portions of the turns travel in contact with the main roller and the subordinate roller. Due to the resultant difference in curvature produced between the paths of travel of the inner portions and outer portions of the coil springs, the adhesive belt-like object can be smoothly separated from the rotating surface of the conveyor.

Since the conveying surface which contacts the object to be conveyed is formed by the external surface or outer portions of the coiled springs, its area of contact with the object is minimized. Accordingly, the degree of adhesion of the adhesive belt-like object to the conveying surface lessens and the object can be conveyed.

BRIEF DESCRIPTION OF THE DRAWINGS

The drawings are related to an embodiment of the present invention in which the conveying device according to the present invention is used with a cutting device for an adhesive belt-like object, in which.

DETAILED DESCRIPTION OF THE PREFERRED EMBODIMENT

The example shown in the attached drawings describes a case in which a pair of conveyors are provided in two stages above and below in the conveying device of the present invention, for holding an object to be moved vertically downwardly, and a cutter which rotates in accordance with the speed of conveyance is provided for cutting the adhesive belt-like object in transit.

The embodiment of the present invention is described below with reference to the drawings.

Figure 3:
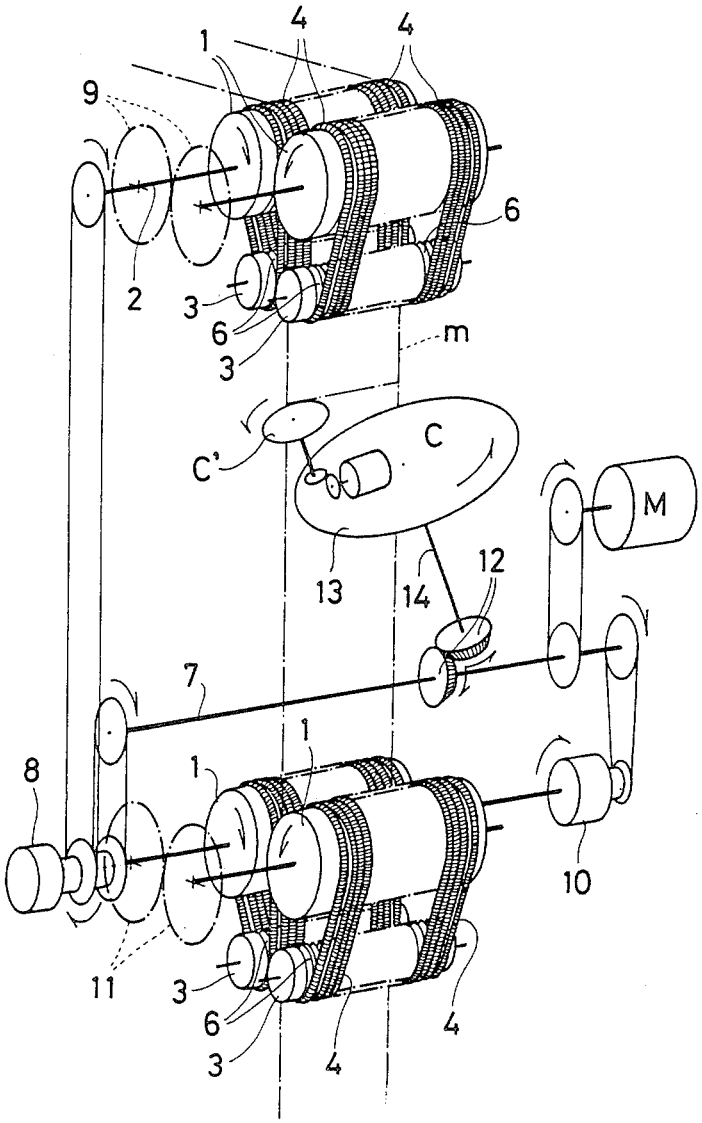
FIG. 3 is a schematic oblique view of a driving mechanism.
Figure 4:
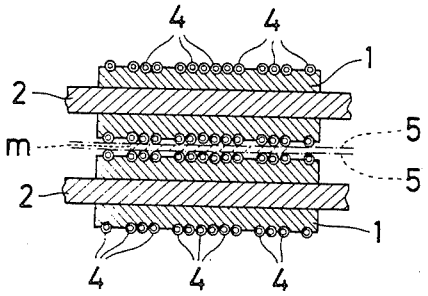
FIG. 4 is a sectional view along line X—X in FIG. 2.
Figure 5:
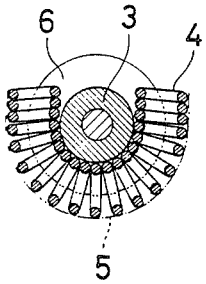
FIG. 5 is an enlarged sectional view, illustrating that when the coiled springs travel around a roller, the pitches of the outer portions of the coiled springs, which are otherwise close together, spread out describing an arc in the places where the inner portions of the coiled springs contact the rotating surface of the roller.

Reference number (1) designates a main roller which has a relatively large diameter, a shaft (2) supporting the main roller and being mounted horizontally on a frame (F) in such a manner that it can rotate freely. Reference number (3) designates a subordinate roller which is placed vertically below the main roller (1) at an appropriate distance. Reference number (4) designates plural coiled or helical springs which are respectively strained or stretched over the main roller (1) and the subordinate roller (3), the rotational axes of which run parallel to each other. Each of the endless helical springs (4) is arranged such that the axis of its helix extends in the direction of conveyance indicated with an arrow on the main roller (1) in FIG. 3, and each spring rotates in an endless path such that inner portions of the coils or turns of the helical springs travel in a first closed loop path and outer portions of the coils or turns travel in a second closed loop path spaced outwardly from the first closed loop path by a distance equal to the diameter of the coils or turns. The springs travel in accordance with the rotation of the main roller (1) and the outer portions of the coils of the springs form a conveying surface along a portion of the second path which minimally contacts an object to be conveyed (m). Reference numeral (6) designates circumferential grooves provided on the circumference of the main roller (1) and on the circumference of the subordinate roller (3) for engaging with the inner portions of the coils of the helical springs (4). As shown in FIG. 4, the springs (4) are arranged on both sides of the object (m) such that the springs on one side of the object (m) are aligned with the springs on the other side of the object (m) to hold the object (m) therebetween.

In this example, a pair of rollers comprising the main roller (1) and the subordinate roller (3) is arranged on each side of the conveyance path in two stages, above and below with respect to each other, between a pair of frames (F) which stand facing each other on both sides of the conveying device. Each of the two stages includes a first pair of rollers comprising the main roller (1) and the subordinate roller (3), over which a plurality of first helical springs (4) are strained or stretched with the axes of their helixes lying in planes which are parallel to one another. The first pair of rollers are mounted horizontally in such a manner that they oppose a second pair of rollers comprising another main roller (1) and another subordinate roller (3) at the same height and having a plurality of second helical springs extending therearound such that the axes their helixes lie in the vertical planes containing the axes of the helixes of the first helical springs. A pair of conveying surfaces (5) opposite to each other in the vertical direction are formed by the opposing surfaces of the outer portions of the first and second helical springs (4) in such a manner that the pair of conveying surfaces hold the object (m) from both sides and send it downward along a conveying path lying in a vertical plane. Another pair of the conveying surfaces (5) (identical to the first pair of conveying surfaces) are provided at the second stage in a lower part of the device in a position vertically aligned with the pair of conveying surfaces at the first stage at the upper part of the device so that the object (m) can be conveyed vertically through the two pairs of conveying surfaces. As can be seen from FIG. 3, each spring in the upper set of springs (4) is vertically aligned with a corresponding one of the springs of the lower set of coil springs (4).

Further, reference character (C) designates a cutter which is provided in the middle between the first and second pairs of conveying surfaces (5) and the cutter (C) has a blade (C') which rotates about a first axis and revolves around a second axis offset from the first axis so that the cutter (C) can cut the object (m) horizontally at about a right angle in conformity with a speed of conveyance of the object (m). The driving mechanism consists of a motor (M) which is arranged as shown in FIG. 3 and includes a main shaft (7), gears (9) which drive the main rollers (1) of the upper first stage through a one-way clutch (8), gears (11) which drive the main rollers (1) of the lower second stage through an electromagnetic clutch (10) and an inclined shaft (14) which turns a base (13) of the cutter (C) through bevel gears (12) mounted on the main shaft (7).

Figure 1:
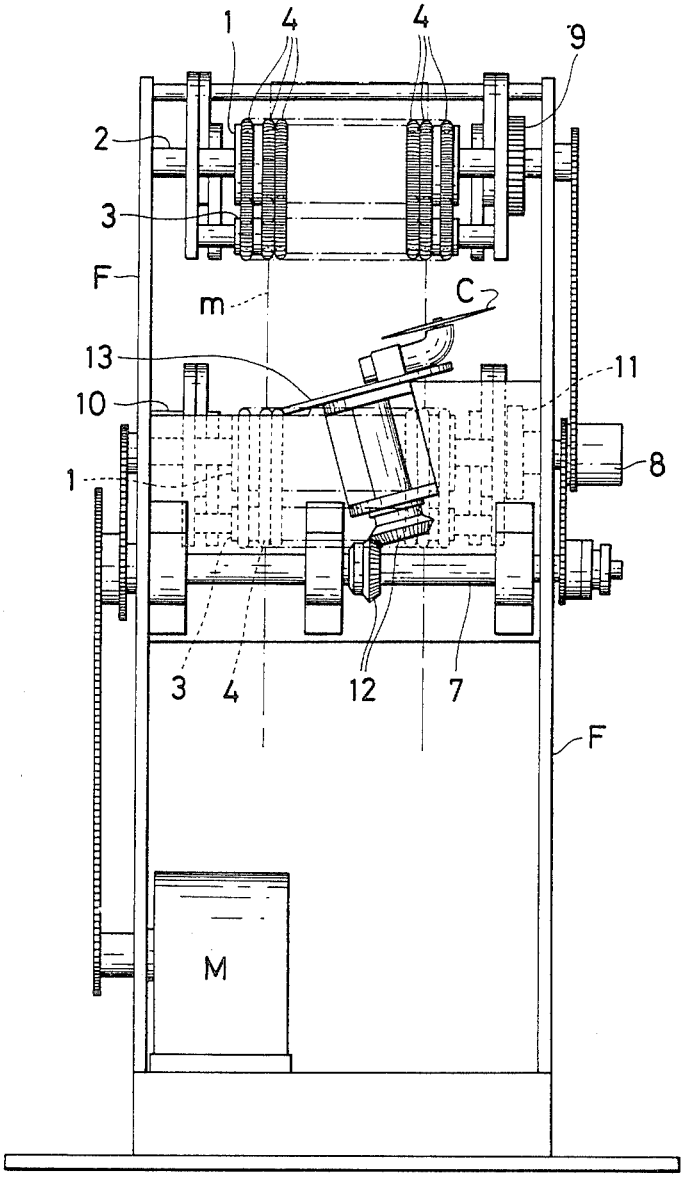
FIG. 1 is a side view of the conveying device according to the present invention.
Figure 2:
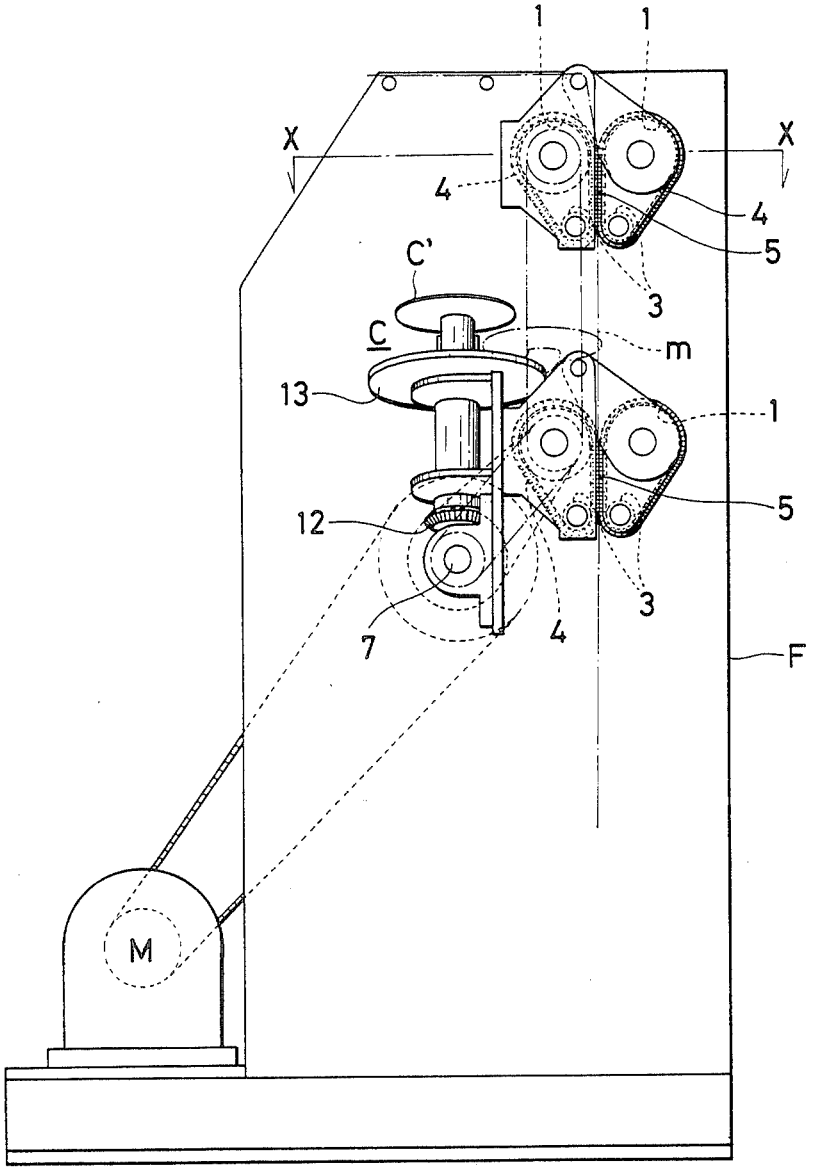
FIG. 2 is a front view of the device illustrated in FIG. 1.

The conveyor of the present invention, utilizing the external surfaces formed on the outer portions of the coiled springs (4) as described for forming the conveying surfaces which contact the object (m) to be conveyed, has the following effects. At the time when the coiled springs travel in an endless path in accordance with the rotation of the main rollers, the pitches or spacing between the outer portions of adjacent coils of the coiled springs spread out describing an arc in the places where the inner portions thereof contact the main roller and the subordinate roller, which results in separation of the adhesive belt-like object from the outer portions of the coils due to the relative change in spacing between adjacent outer portions of the coils as they travel around the subordinate rollers. As a result, the adhesive belt-like object can be smoothly separated from each stage of the conveyor at a position in the vertical plane of the conveying surfaces which is perpendicular to the axis of the opposing subordinate rollers (3), as shown in FIG. 2, without being caught by the rotating surface of the conveyor. Due to the curved outer peripheral portions of the helical springs, each of which has its axis of its helix parallel to the direction of conveyance for portions thereof along the conveying path, it is possible to minimize the area of contact of the helical springs with the object (m) to be conveyed and accordingly it is possible to reduce the adhesion of the adhesive object to the conveying surfaces of the conveyor to a minimum when conveying the adhesive belt-like object. Further, in the case of cutting the adhesive belt-like object while in transit, the conveyor does not suffer from any noticeable adhesion of the adhesive object to the conveying surface (5) which allows the conveyor to be used repeatedly over a long period of time even if the adhesive object (m) is held from opposite sides, as well as above and below the position for cutting, thus allowing an improved cutting action to take place.

While the present invention has been described with reference to the foregoing embodiment, various changes and modifications may be made thereto without departing from the invention defined in the appended claims.

I claim:

1. A conveyor for conveying an adhesive belt-like object, comprising:

means for guiding the adhesive belt-like object along a conveying path from a first position to a second position, said guiding means including a first plurality of mutually aligned endless helical springs and a second plurality of mutually aligned endless helical springs, each of said first and second plurality of endless springs having a contact portion for contacting said belt-like object, the contact portion of each of said first plurality of springs facing and being aligned with the respective one of the contact portions of said second plurality of springs so that said contact portions of said springs contact opposite sides of said belt-like object to form a minimal contact area therebetween, a portion of coils of each spring forming said contact portion; and means for rotating said endless helical springs in contact with the adhesive belt-like object along said conveying path and for separating the adhesive belt-like object from said contact portions of said helical endless springs at said second position, so as to convey the adhesive belt-like object in a forward direction from said first position to said second position and release said endless helical springs from the adhesive belt-like object at said second position, said rotating means including a first pair of spaced-apart rollers, one of said first pair of rollers being positioned at said second position and said first plurality of springs rotating around said first pair of rollers, said rotating means further comprising a second pair of spaced-apart rollers, one of said second pair of rollers being positioned at said second position and said second plurality of springs rotating around said second pair of rollers, adjacent contact portions of said coils of each of said first and second plurality of springs being separated by a distance which increases as said springs travel around said roller positioned at said second position; whereby the adhesive belt-like object is separated from said springs at said second position.

2. A conveyor for conveying an adhesive belt-like object as in claim 1, wherein said endless helical springs engage with circumferential grooves which are provided on said main roller and subordinate roller in their circumferential direction.

3. A conveyor for conveying an adhesive belt-like object, comprising:

means for guiding the adhesive belt-like object vertically along a vertical plane from an upper level to a lower level thereof, said guiding means including a plurality of first endless coil springs directed in parallel along a first path on one side of said vertical plane along which outer surfaces of said first endless coil springs are directed vertically and face said vertical plane from said upper level to said lower level, and a plurality of second endless coil springs directed in a parallel along a second path on the other side of said plane along which outer surfaces of each of said second coil springs are directed vertically and in alignment with a respective one of the outer surfaces of said first coil springs so that said outer surfaces of said springs contact opposite sides of said belt-like object to form a minimal contact area therebetween; and moving means for moving said guiding means so as to convey the object respectively from said upper level to said lower level of said guiding means, and release said guiding means from the object in said plane at said lower level, said moving means including rotating means for rotating said first and second endless coil springs in contact with the opposite sides of the object in said plane and out of contact with the opposite sides of the object in said plane to thereby separate the object in said plane from said first and second endless coil springs, at said lower level;

said rotating means including a first pair of rollers comprising a rotatively driven first main roller and a freely rotatable first subordinate roller, one above the other on one side of said plane, said first endless coil springs being trained over said first main roller and said first subordinate roller such that said first endless coil springs are strained, outer portions of adjacent turns of each of said first coil springs being separated at a pitch, whereby the pitch of the outer portions of said first endless coil springs increases since the distance between the outer portions is expanded by the lower one of said first pair of rollers due to a difference in curvature between a path of travel of the outer surfaces of said first endless coil springs and a path of travel of inner surfaces thereof containing said lower one of said first pair of rollers as said first endless coil springs travel therearound, the expansion of the pitch causing the object to separate in said plane from the outer surfaces of said first endless coil springs at said lower level;

said rotating means further including a second pair of rollers comprising a rotatively driven second main roller and a freely rotatable second subordinate roller, one above the other on the other side of said plane, said second endless coil springs being trained over said second main roller and said second subordinate roller such that said second endless coil springs are strained, adjacent turns of each coil of said second coil springs being separated at a pitch, whereby the pitch of outer portions of said second endless coil springs increases since the distance between the outer portions is expanded by the lower one of said second pair of rollers due to a difference in curvature between a path of travel of the outer surfaces of said second endless coil springs and a path of travel of inner surfaces thereof contacting said lower one of said second pair of rollers as said second endless coil springs travel therearound, the expansion of the pitch causing the object to separate in said plane from the outer surfaces of said second endless coil springs at said lower level.

* * * * *